US007878874B2

(12) United States Patent
Gruenwald

(10) Patent No.: US 7,878,874 B2
(45) Date of Patent: Feb. 1, 2011

(54) MARINE VESSEL PROPULSION DRIVE MODULE

(75) Inventor: David Gruenwald, Allentown, WI (US)

(73) Assignee: Brooks Stevens Design Associates, Inc., Allentown, WI (US)

( * ) Notice: Subject to any disclaimer, the term of this patent is extended or adjusted under 35 U.S.C. 154(b) by 0 days.

(21) Appl. No.: 12/030,084

(22) Filed: Feb. 12, 2008

(65) Prior Publication Data

US 2009/0047847 A1 Feb. 19, 2009

Related U.S. Application Data

(60) Provisional application No. 60/889,596, filed on Feb. 13, 2007.

(51) Int. Cl.
*B63H 20/14* (2006.01)
*B63H 23/00* (2006.01)

(52) U.S. Cl. ..... 440/75

(58) Field of Classification Search ..... 440/49, 440/51, 53, 57, 66, 68, 69, 75, 111, 112
See application file for complete search history.

(56) References Cited

U.S. PATENT DOCUMENTS

| | | | | |
|---|---|---|---|---|
| 2,244,217 | A | | 6/1941 | Pries |
| 2,976,836 | A | | 3/1961 | Fageol |
| 3,035,538 | A | | 5/1962 | Willard |
| 3,164,122 | A | * | 1/1965 | Fageol ..... 440/52 |
| 3,859,953 | A | | 1/1975 | Todt |
| 4,637,801 | A | | 1/1987 | Schultz |
| 4,680,017 | A | | 7/1987 | Eller |
| 4,689,206 | A | | 8/1987 | Owen et al. |
| 4,694,645 | A | | 9/1987 | Flyborg |
| 4,789,302 | A | | 12/1988 | Gruzling |
| 4,826,461 | A | | 5/1989 | Newman |
| 4,907,994 | A | | 3/1990 | Jones |
| 4,957,459 | A | | 9/1990 | Snyder |
| 5,108,325 | A | * | 4/1992 | Livingston et al. ..... 440/112 |
| 5,326,294 | A | | 7/1994 | Schoell |
| 5,890,937 | A | | 4/1999 | Granger |
| 6,045,420 | A | | 4/2000 | Small et al. |
| 6,193,573 | B1 | | 2/2001 | Small |
| 6,213,824 | B1 | | 4/2001 | Small |
| 6,260,503 | B1 | | 7/2001 | Allison |
| 6,293,218 | B1 | | 9/2001 | White |
| 6,406,341 | B1 | | 6/2002 | Morejohn |
| 6,475,045 | B2 | | 11/2002 | Schultz et al. |
| 6,544,082 | B1 | | 4/2003 | Finnerty |
| 6,863,013 | B2 | | 3/2005 | Noyes |
| 7,311,059 | B2 | | 12/2007 | Loui et al. |

* cited by examiner

*Primary Examiner*—Daniel V Venne
(74) *Attorney, Agent, or Firm*—McHale & Slavin, P.A.

(57) ABSTRACT

A drop-in-module consisting of a mass produced engine coupled to a drive system by use of a common mid-section mounting platform. The module provides a single assembly that can be easily installed and removed from a vessel. The drive system is based on motors using a vertical crankshaft orientation joined to a 90 degree gearbox with a forward-neutral-reverse transmission. A speed sensitive clutch arrangement separates the engine from the gearbox. The heat created by the air cooled versions of these engines can be vented into the propeller wash through a passage formed in the mounting plate.

9 Claims, 15 Drawing Sheets

SECTION A-A

MARINE VESSEL PROPULSION DRIVE MODULE

PRIORITY APPLICATION

This Application is based upon Provisional Patent Application No. 60/889,596 filed Feb. 13, 2007 and related to application Ser. No. 12/030,029 filed simultaneously with the instant application on Feb. 12, 2008, the contents of which are incorporated herein by reference.

FIELD OF THE INVENTION

This invention is directed to the field of watercraft, and in particular to a propulsion system that installs into the vessel as a single complete module, the propulsion system having an RPM sensitive clutch positioned between the engine and the propeller and integrated into the mounting plate, and a means for ducting engine cooling air out of the engine box.

BACKGROUND OF THE INVENTION

The cost of outboard motors has increased at an alarming rate. The average yearly price increase over the last ten years has been 6.5% with an 11.5% increase attributable to 2005 alone. An outboard motor can account for over 60% of the cost of a boat/motor/trailer package. This high cost has become a serious hindrance to attracting new customers to the recreational activity of boating.

It is well known in the field of marine propulsion that it is advantageous to use engines designed and manufactured for use in other, higher volume industries. For example, gasoline engines from the automotive industry are the predominant power source to the marine industry for small to mid-size vessels that rely upon stern drives and inboards. The primary power source for larger vessels is diesel engines adapted for use from the trucking industry.

While engines from the automotive and trucking industry provide cost advantages over custom built engines, such as outboard motors, the adaptation still requires the use of customized cooling systems and other modifications that can be most expensive.

Any time an engine designed for another industry is adapted for use in the Marine environment; there are design barriers which must be overcome. For instance, automobile engines corrode when exposed to salt water found in oceans. So closed cooling systems are often added to protect the iron engine blocks.

Further, since engines designed for other industries are not anticipated to be installed in a boat, one must find a way to make such installation simple and cost effective.

The lowest cost engines in the world, on a $/hp basis, come from the L&G (Lawn and Garden) industry. Unfortunately these engines are not designed to be used in boats.

The idle rpm of L&G engines are unacceptable for a marine application, often approaching 1,800 rpm when a conventional outboard motor would be expected to idle at less than 1,000 rpm.

Finally, L&G engines that are the most cost effective are air cooled. So one must find ways to bring cool air into the lawn and garden engine and dispose of that hot air in a safe and cost effective manner.

U.S. Pat. No. 3,164,122 by Fageol discloses a transom mounted propulsion assembly. Fageol does not employ commonly available motors or rudder systems.

U.S. Pat. No. 2,976,836 by Fageol discloses a vertical shaft inboard marine power plant wherein the drive assembly is in combination with the rudder. The engine and drive assembly are secured by a ball and socket assembly wherein the propeller is moved to cause directional steering of the vessel.

U.S. Pat. No. 4,907,994 by Jones discloses a drive system for a vessel wherein the propeller is moved to cause directional steering of the vessel.

U.S. Pat. No. 5,108,325 by Livingston discloses a drive system for a vessel wherein the propeller is moved to cause directional steering of the vessel, and further allows elevated movement of the propeller.

U.S. Pat. No. 5,326,294 by Schoel discloses a stern drive system for a vessel wherein the propeller and rudder are moved to cause directional steering of the vessel.

One of the problems with the prior art is the movement of the propeller induces inefficiencies in operation by changing the flow characteristics as well as inducing unpredictable flow currents in relation to the hull.

Thus, what is needed in the marine industry is a low cost mass produced engine from the lawn and garden industry that provides the performance, installation ease, idle quality and reliability of an outboard motor, without the associated specialty motor expense.

SUMMARY OF THE INVENTION

The instant invention is a drop-in-module or "D.I.M." consisting of a conventional vertical crankshaft mass produced motor coupled to a drive system by an interfacing mounting plate. The assembly provides a single module that can be placed in watercraft with minimal installation expense. The preferred power source for this module is an air cooled vertical crankshaft engine from the lawn and garden industry although water cooled engines could also be used. Such engines are mass produced in extremely high volumes and so have a very low cost.

An objective of the invention is to provide an engine that utilizes a vertical crankshaft orientation joined to a 90 degree gearbox with a forward-neutral-reverse transmission. The components are rigidly bolted together as a single assembly and available for placement into a generally horizontal opening in a vented tunnel system although this surface can be inclined as well. The engine may be bolted to the mounting plate rigidly or if desired, rubber isolators can be placed between the engine and the mounting plate to reduce vibration and noise.

Still another objective of the instant invention is to teach the use of air cooled engines from the lawn and garden industry to avoid the expensive cooling systems, wherein engine heat is drawn into the vented tunnel for mixing with prop wash.

Another objective of the invention is to teach the use of clutches to permit the use of engines with high idle rpms. Still another objective of the invention is to teach the use of stacking inexpensive centrifugal clutches together in parallel.

Yet still another objective of the invention is to employ a wet disk located inside the gear case on the vertical drive shaft. At low speeds the wet disk clutch can tolerate light slip loads indefinitely and the heat can be dissipated in the tunnel as it is almost fully wetted at the slip speeds.

Still another objective of the invention is to provide a drop in module for use in a tunnel created for surface piercing propellers. The rigid assembly is protected from impact by the tunnel shape effectively providing a zero draft vessel.

Still another objective of this invention is to teach ways to extract and remove hot air from the cooling fan of an air cooled engine and safely dispose of it in a vessel environment.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

The preferred embodiment is to use vertical crankshaft engines from the Lawn and Garden industry which are considerably less expensive than the same horsepower horizontal crankshaft orientation engines. The engine is coupled to a fixed gear box. Unlike outboards the gear box does not rotate for purposes of steering. Further, the fixed gear box eliminates the need for the complex gimbal used in inboard/outboards. In the instant invention, conventional rudders are employed. Rudders are proven reliable and can be mounted independently to the hull or in combination with the engine mounting plate.

Figure 1:
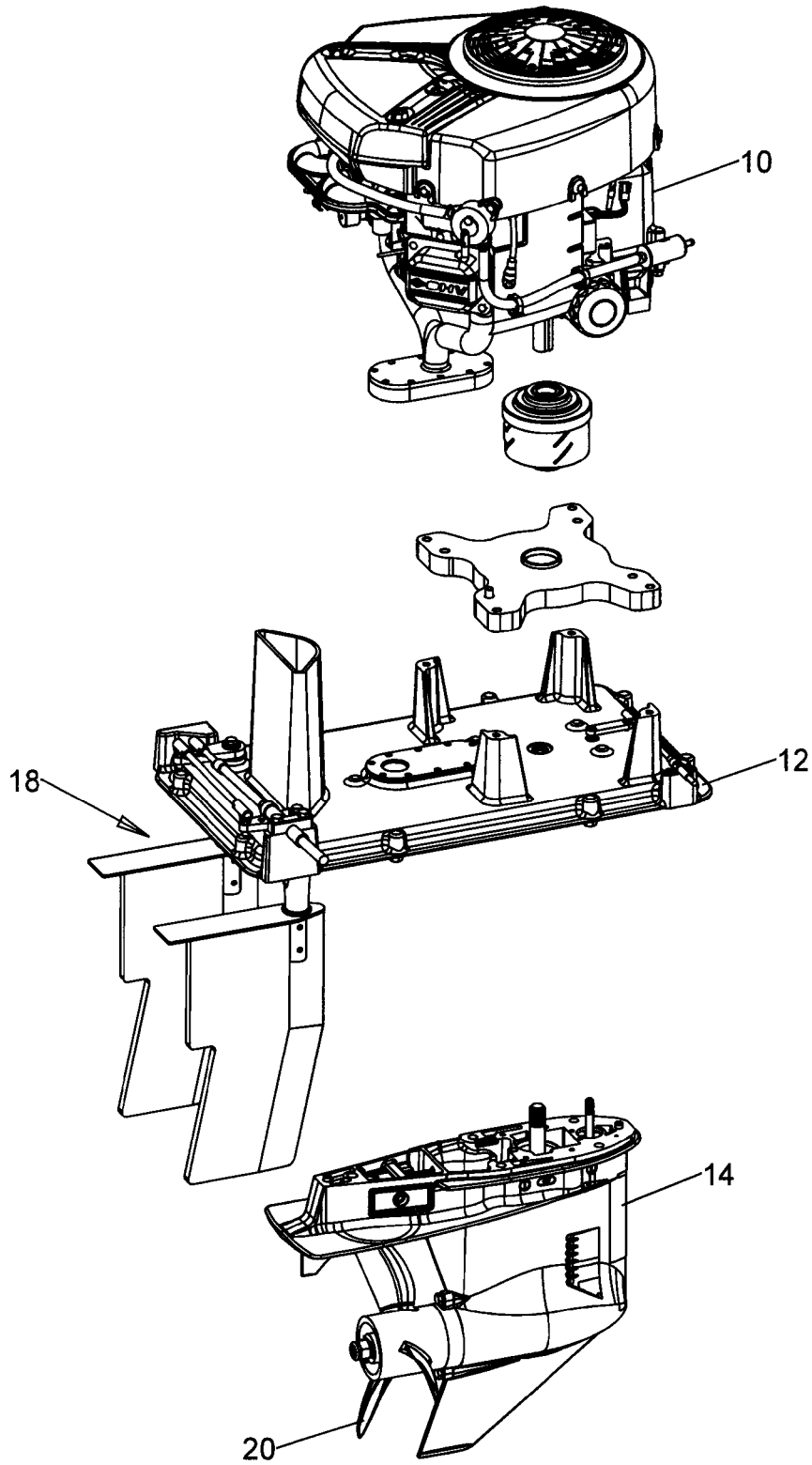
FIG. 1 is an exploded view of the drop in module.
Figure 2:
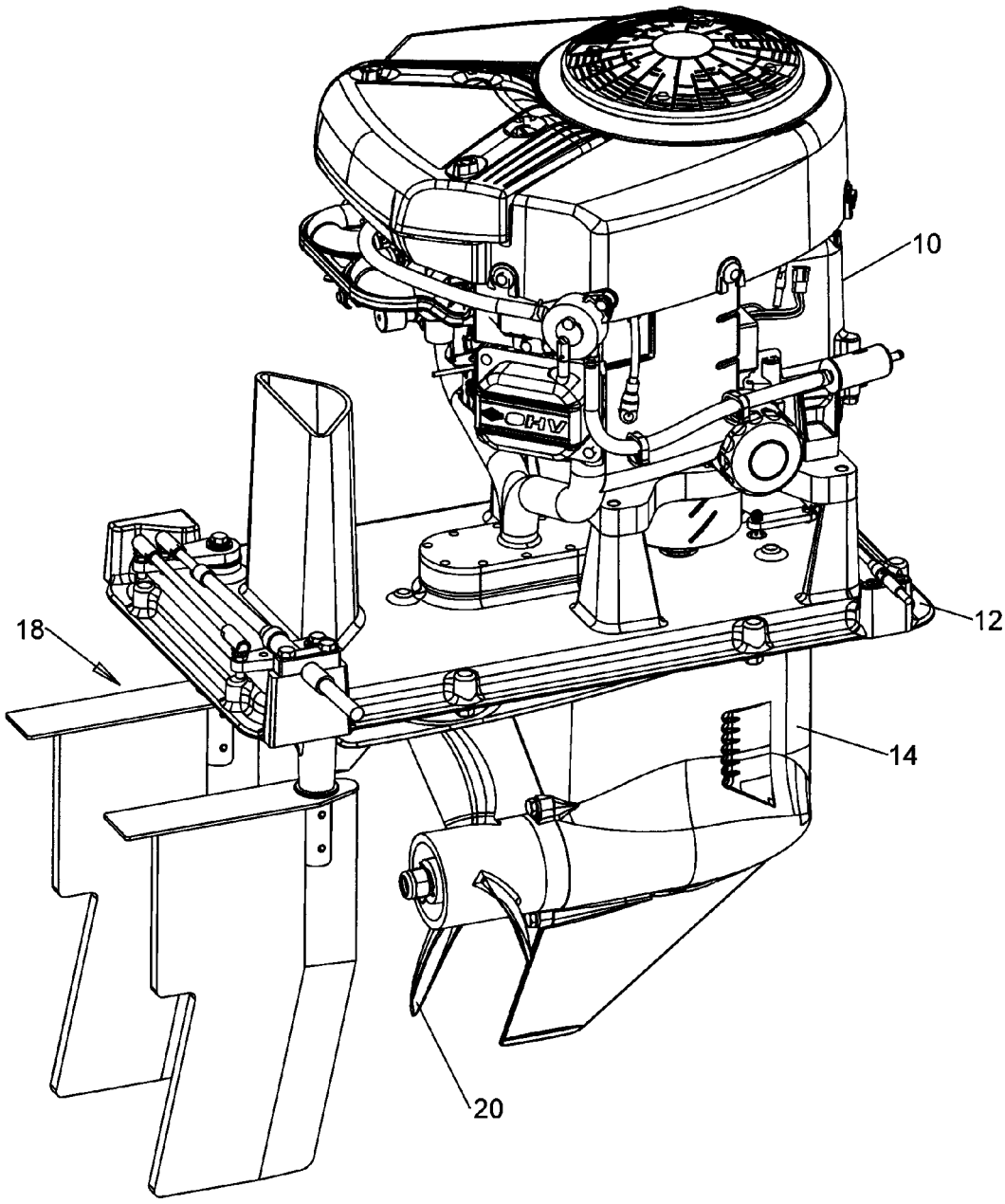
FIG. 2 is a perspective view of the drop in module.
Figure 3:
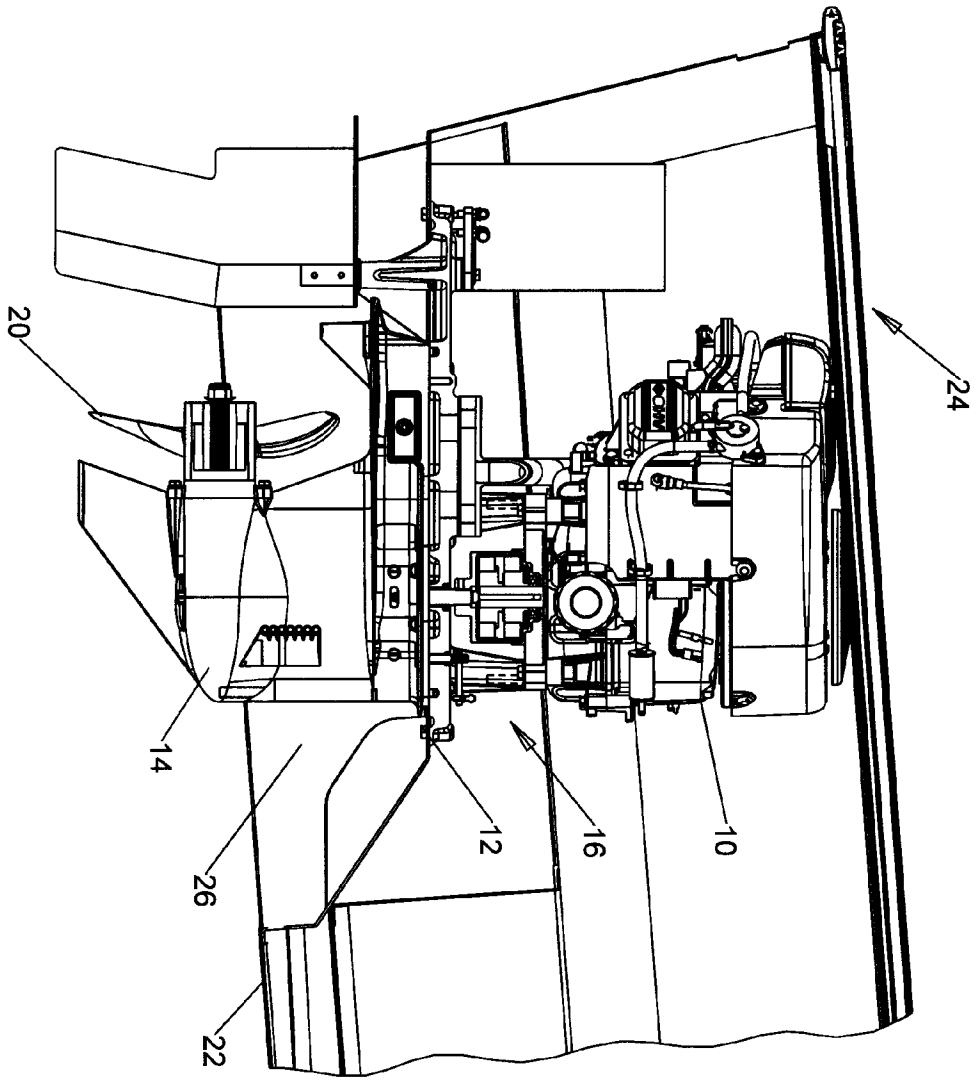
FIG. 3 is a perspective view of a watercraft with the drop in module in the vessel's hull.

FIGS. 1 through 3 depict a general overview of the drop in module employing the air cooled engine (10) having a vertical shaft for securement to a mid-section mounting base (12). The mid-section mounting base operates as a securement platform with attachment fasteners to secure the engine and gear case (14) into a single assembly. The single assembly (16) can then be dropped in the vessel as a fully assembly module requiring connections only for the controls, fuel and electrical. The fasteners and seal, not shown, allow a fully tested assembly to be secured to a vessel hull with minimal effort. The result is a module that can be easily removed for repair or replacement. In addition, the use of a conventional rudder assembly (18) can be secured to the mid-section mounting plate and a conventional steering system or means, further simplifying the installation. This assembly (16) provides a bolt-on propulsion and steering system for a watercraft.

Figure 4:
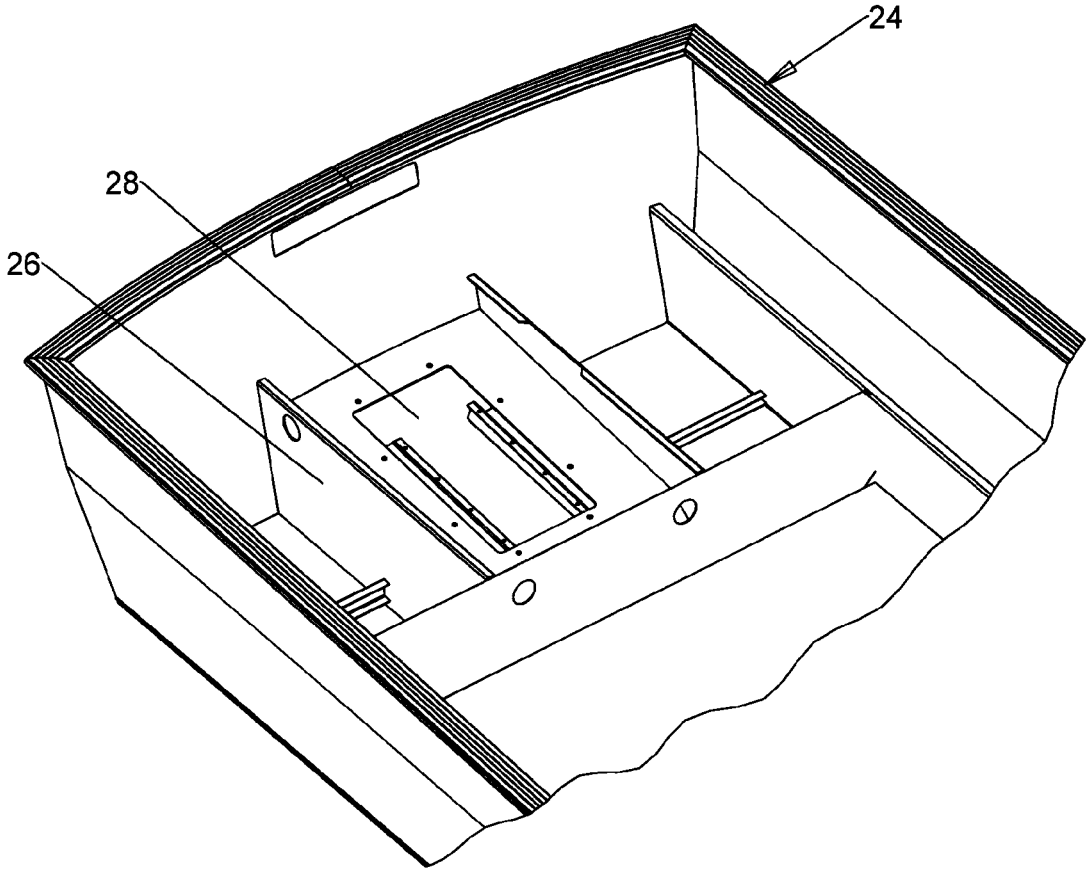
FIG. 4 is a top view of the watercraft's hull without the module installed.

FIG. 4 depicts a vessel (24) having a full side wall tunnel (26) with an opening (28) available for securement of the drop in module assembly (16). The module (16) is bolted in place through use of the fastening holes. Once installed, the controls can be supplied for operation of the engine, gear case, and rudders. The electrical is attached and fuel lines thereby facilitating installation. It should be noted that the use of the tunnel allows the propeller (20) and gear case (14) to be located above the keel (22) of the vessel to prevent damage from impact. Further, the use of a tunnel has been found most beneficial when used with surface piercing propellers. Surface piercing propellers obtain optimum efficiency when operated under a vented condition wherein air is drawn into the tunnel. This has a unique effect of removing pressure from the roof of the tunnel thereby diminishing the possibility of a pressure induced lead around the mounting base. The propeller also provides a propeller fluid flow which in turn moves the watercraft forward.

The use of an internal combustion engine necessitates cooling due to engine inefficiencies. The use of an air cooled engine is properly cooled by ventilation of the engine, the heated air must be then drawn away from the engine. In the preferred embodiment, the hot engine air is drawn into the vented tunnel (26), as shown in pictorial of FIG. 5; with air exiting through the primary air feed holes in the side wall of the tunnel 26.

The tunnel shape for surface piercing propellers is disclosed in U.S. Pat. Nos. 4,689,026; 6,045,420; 6,193,573; and 6,213,824, all of which are incorporated herein by reference. Air drawn from around the engine exits the back of the boat with the prop wash. As shown in FIGS. 5, 6, 7 and 8, hot air from around the engine is drawn into hot air ducts 32 formed as a component of the mounting plate 12. The hot air duct has an inlet in an area adjacent the engine and an outlet that communicates with a passageway 35. Passageway 35 has a first opening 36 on the stern of the vessel and a second opening 38 into tunnel 26 at a location forward of gear case 14.

Figure 5:
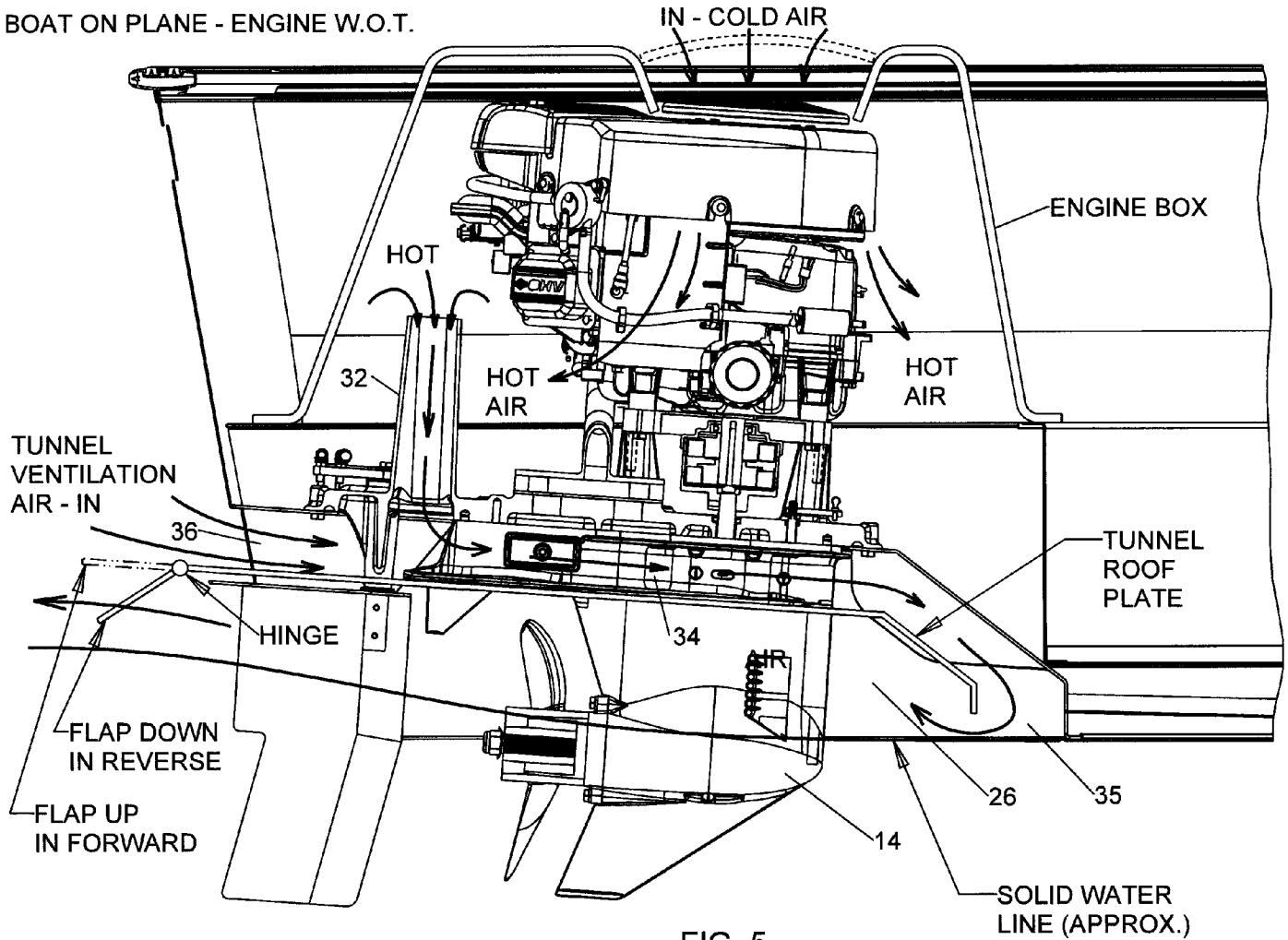
FIG. 5 is a cross sectional side view of the propulsion module mounted within the vessel showing the engine hot air exhaust when the vessel is on plane.

As shown in FIG. 5, when the vessel is on plane with wide open throttle, air is drawn in from the first opening 36 on the stern as well as the inlet of the hot air duct 32 into passageway 35. The combined flows are then induced to flow out of the second opening 38 in passageway 35 and into the tunnel 26 at a location ahead of the gear case 14.

Figure 6:
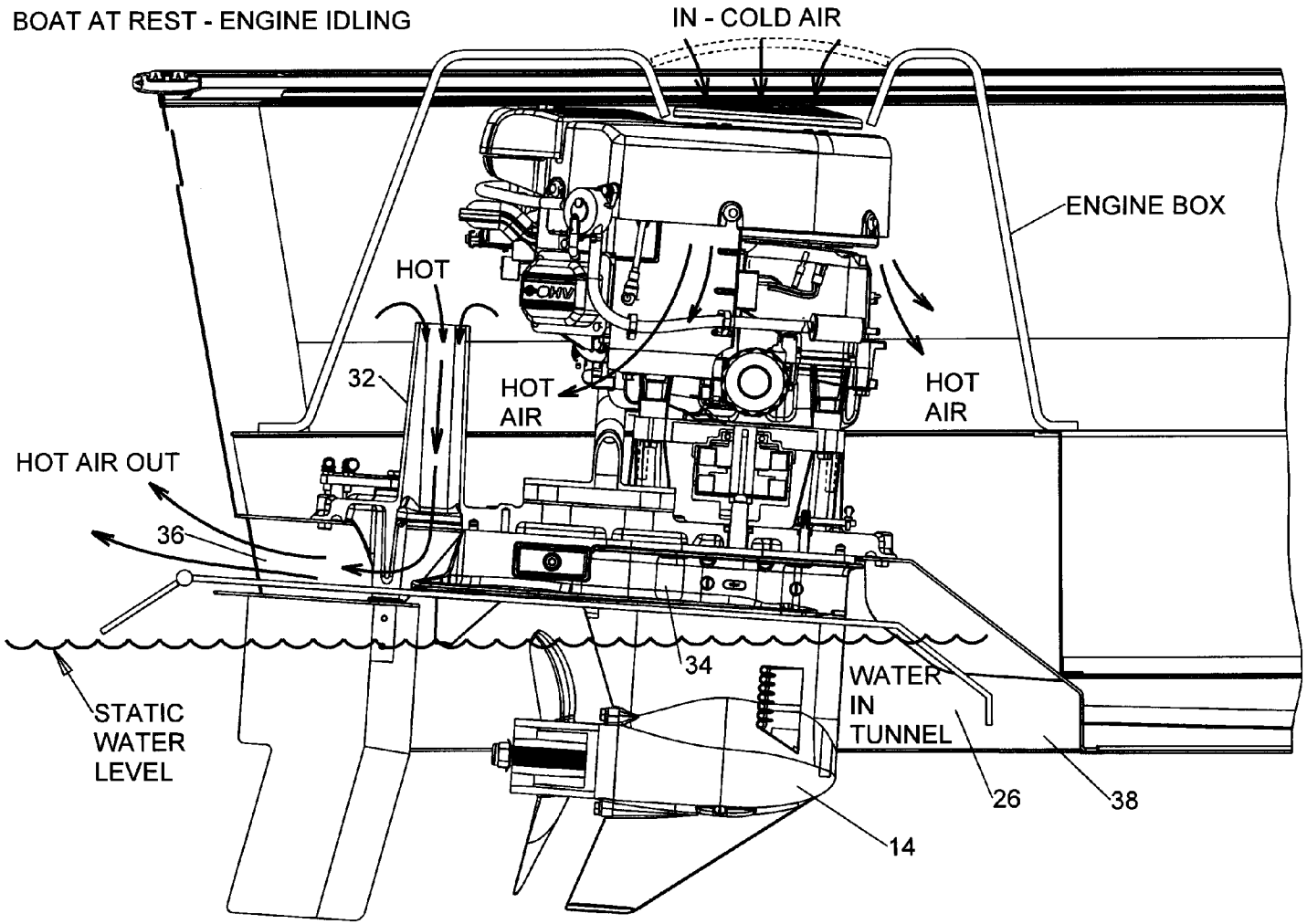
FIG. 6 is a cross sectional side view of the propulsion module mounted within the vessel showing the engine hot air exhaust when the vessel is as rest with the engine in idle.

FIG. 6 is a view of the hot air flow when the vessel is at rest and the engine is idling. In this mode of operation the hot air from around the engine enters hot air duct 32 and passes into passageway 35. This forms a venting means to cool the engine. As a result of the second opening 38 being filled with water, the hot air entering passageway 35 exits the vessel through first opening 36 and out the stern of the vessel.

The use of an air cooled engine requires that a high volume of hot air be managed. In one embodiment the engine can be left completely uncovered, like a riding lawn mower without the hood installed, but is unsightly for most installations. Covering the engine with an insulated box requires cold air to be drawn into the engine compartment and expelled. The expelled air is ducted from inside the box (around the engine) through a passage formed in the mounting plate that secures the engine and gear case to the vessel and into the air baffle system of the tunnel. Since the tunnel requires large amounts of air to properly ventilate the surface piercing propeller, the tunnel can be used to pull the hot air out of the engine box. The tunnel will cool the hot gases so they can be safely discarded and by mixing the gases with the water from the propeller any noise coming out of the engine box with the hot gases will be muffled and sound levels reduced. While this method of hot air extraction works well once the vessel is moving forward with sufficient speed to ventilate the tunnel this method does not work when the vessel is at rest and idling. Under this condition, hot air must be given a path to exit the engine box and escape into the air inlet passage above the static water line of the vessel and out the transom as shown in FIG. 6.

Figure 7:
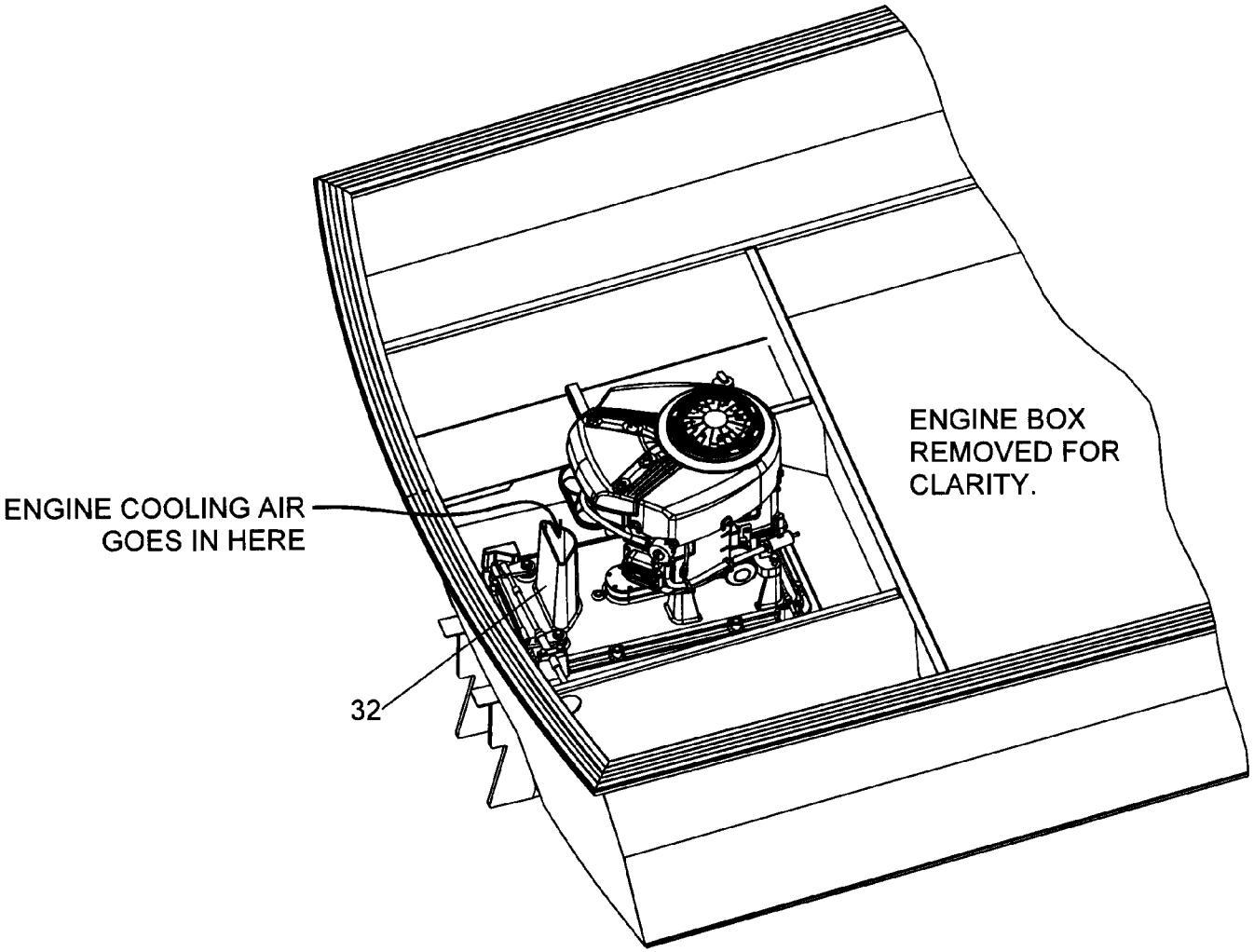
FIG. 7 is a top view of the module mounted within the vessel with the engine box cover removed.
Figure 8:
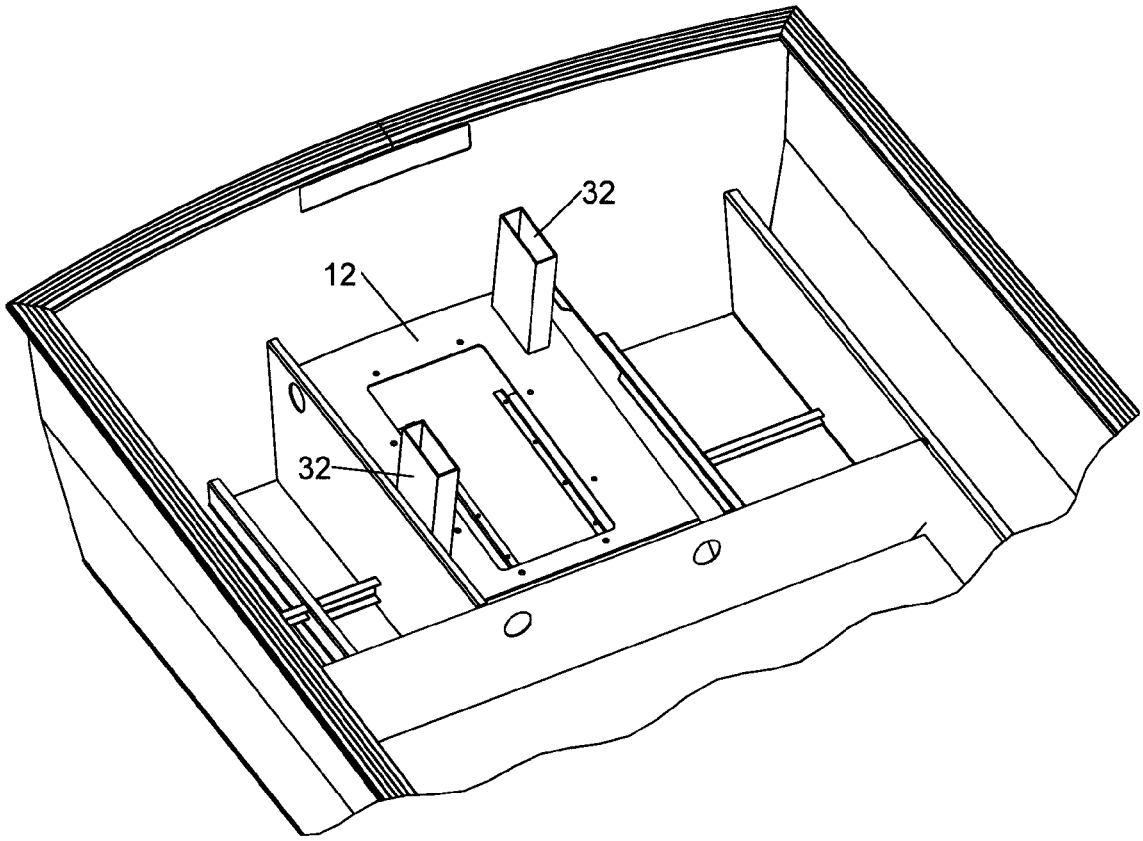
FIG. 8 is a top view of the mounting plate within the vessel showing a plurality of hot air ducts located thereon.

FIG. 7 shows a top view perspective of the installed engine with an engine cover box removed for clarity. A single hot air duct 32 is shown on mounting plate 12. FIG. 8 shows an alternative embodiment with two hot air ducts 32 on mounting plate 12.

Figure 9:
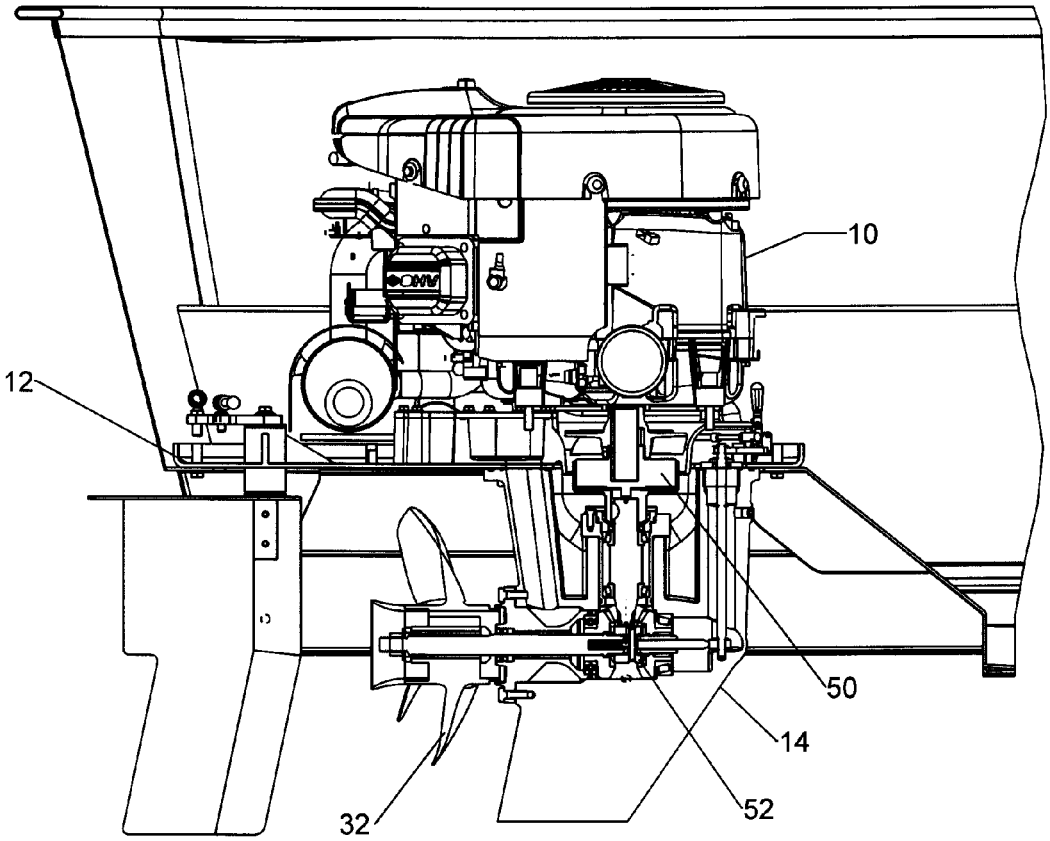
FIG. 9 is a sectional view of the module showing the engine, the mounting plate, the clutches and the propeller casing.

FIG. 9 illustrates the engine (10) bolted to the gear house (14) with mid-section mounting plate (12). A centrifugal and/or electric and/or wet disk clutch (50) isolates the engine from the propeller (32). A dog clutch (52) enacts for neutral or reverse propeller rotation.

Lawn and Garden engines have idle speeds (defined as the lower engine rpm that the engine will continue to run with some load on it), in the range of 1,400-2,000 rpm. Conventional outboards have idle speeds between 600 and 800 rpm or half to one-third of those found in Lawn and Garden type engines. In addition, the maximum operating speeds are routinely governed at 3,600 rpm whereas Outboard engines are in the range of 5,000 or 6,500 rpm. The ratio of maximum engine speed to minimum engine speed is a critical factor in determining how slow the boat will idle. Outboards idle at speeds from 2-3 mph while the use of a L&G engine in this same application produces minimum idle speeds of 6-7 mph, far in excess of what is required for trolling and too fast for safe docking, especially by a novice boater.

The instant invention places another clutch, a clutch that can slip indefinitely at low levels of torque, between the engine and the dog clutch in the gear case. This clutch's purpose is two fold. First to disengage the engine from the propeller so that even it the dog clutch in the gear case is in gear (forward or reverse) the engine can idle at any idle speed and the boat does not move and second, to lock up at some point and transfer the full power of the engine to the propeller. As engine rpm is increased we begin to slowly increase propeller rpm. At a critical and predetermined boat speed or engine load, the clutch will lock up and engine speed and propeller speed will then be directly related in a ratio determined by the ratio in the gear case.

The problem is that very few clutches are able to slip indefinitely. Most, like centrifugal clutches, become hot when they slip and so they are not designed to slip for a long time. Electric clutches have the same problem; they will overheat if they slip for too long.

It has been determined that in order to overcome this design problem cost effectively the preferred embodiment is a stack of low cost centrifugal clutches normally found in use on Go-carts and other small vehicles. By stacking multiple low cost clutches one overcomes the overheating problem by having excess capacity in the clutching system.

In another embodiment, a hybrid clutch is employed. In this embodiment there are two clutches in parallel, one electric clutch and one centrifugal. Initially the centrifugal clutch operates to allow the engine to idle at any speed and not turn the prop at all. Once engine rpm is increased the centrifugal clutch begins to engage. As engine load (throttle) is increased the propeller turns faster and the clutch slips less. At some predetermined load (throttle opening) the electric clutch is switched on and the centrifugal clutch is taken out of the loop. This stops the centrifugal clutch from overheating.

Figure 10A:
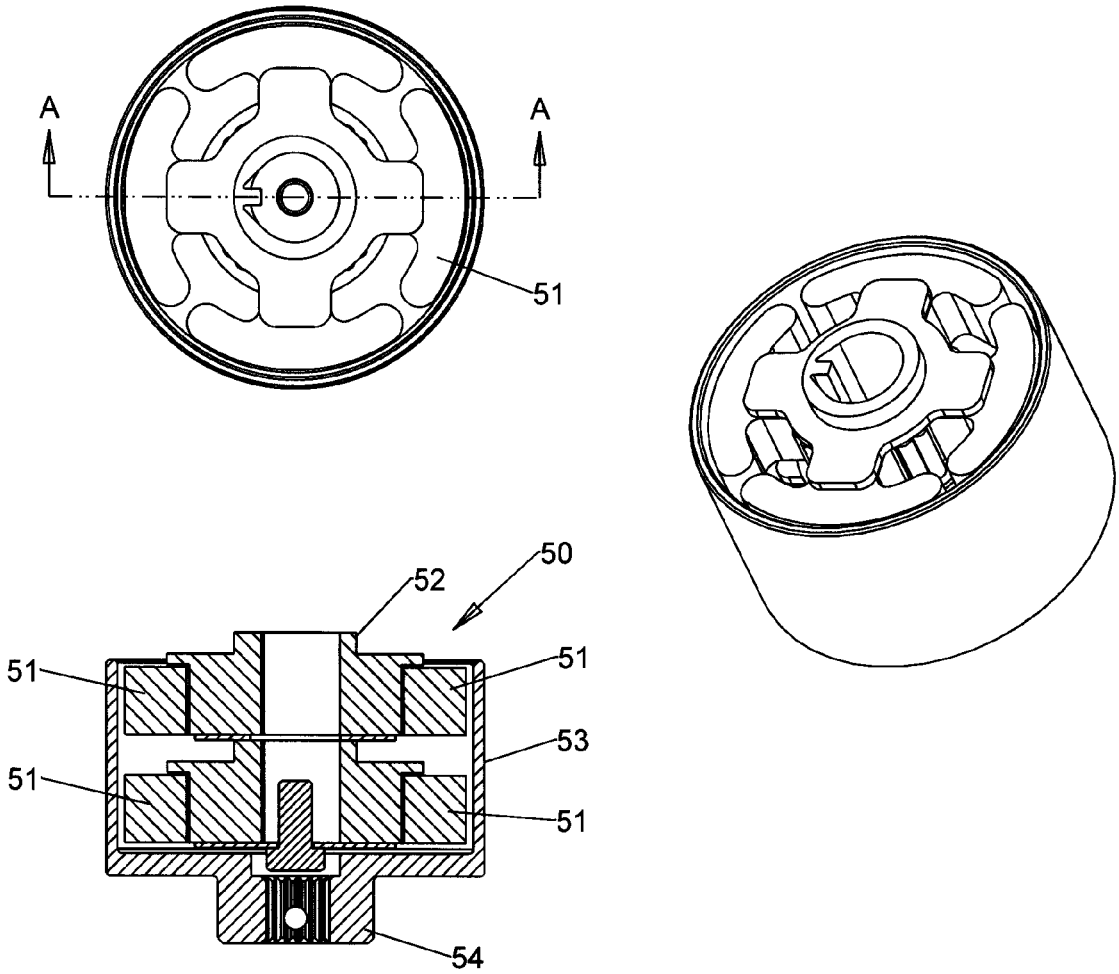
FIGS. 10A, 10B, 10C and 10D are prospective views of alternate embodiments of the slip clutches.
Figure 10B:
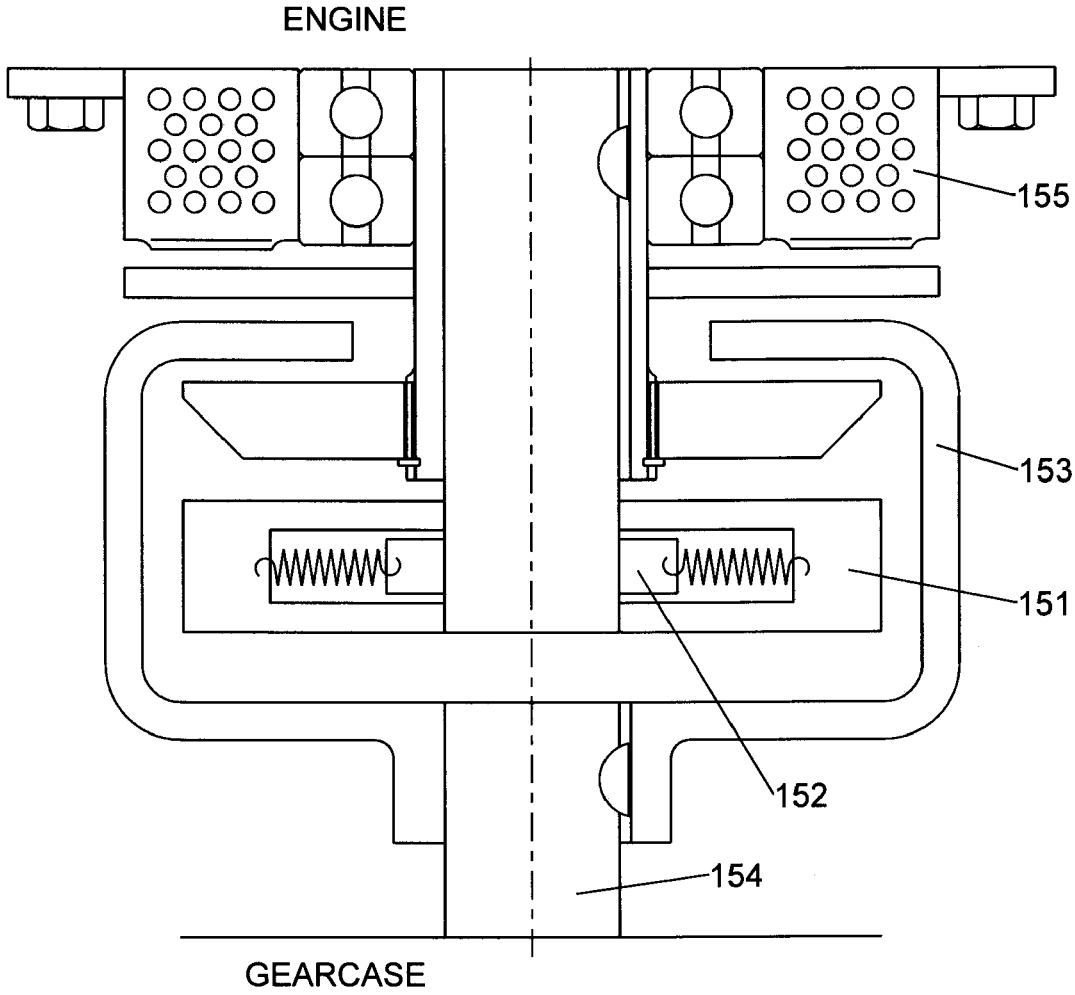

FIG. 10*b* shows an embodiment of clutch 50 wherein the clutch includes a centrifugal clutch as well as an electromagnetic clutch. The motor drive shaft is connected to clutch 50 input shaft 152. Clutch input shaft 152 includes friction shoes 151 mounted thereon. Friction shoes 151 are mounted to allow radial motion of shoes so as to contact the inner surface of outer hub 153 when sufficient centrifugal acceleration is generated due to the rotation speed of the motor drive shaft. Within a predetermined range of motor RPM the shoes 151 will intermittently contact the inner surface of the outer hub 153 and transmit rotation to the clutch output shaft 154 on outer hub 153. Clutch input shaft 152 includes an electro mechanical clutch coil 155. Outer hub 153 contains armature elements that will be selectively actuated. At a predetermined RPM the armature will be actuated thereby causing the drive shaft 152 to engage the inner surface of hub 153 via the clutching elements to lock against the inner surface of hub 153 and provide 1:1 rotational velocity of the input shaft 152 to the output shaft 154.

In another embodiment, an increase to the clutch capacity is made by stacking multiple low cost high volume metallic shoe clutches together in parallel. In this embodiment, high capacity is obtained but because the clutch shoe material is less sensitive to heat. FIG. 10*a* shows this embodiment of clutch 50. The motor drive shaft is connected to clutch 50 input shaft 52. Clutch input shaft 52 includes friction shoes 51 mounted thereon. Friction shoes 51 are mounted to allow radial motion of shoes so as to contact the inner surface of outer hub 53 when sufficient centrifugal acceleration is generated due to the rotation speed of the motor drive shaft. Within a predetermined range of motor RPM the shoes 51 will intermittently contact the inner surface of the outer hub 53 and transmit rotation to the clutch output shaft 54 on outer hub 53. Under sufficient motor RPM, the centrifugal acceleration will be high enough to cause the shoes 51 to lock against the inner surface of hub 53 and provide 1:1 rotational velocity of the input shaft 52 to the output shaft 54. While this embodiment as illustrated shows two stacks of four shoes, more shoes 51 could be used if the application requires.

Figure 10C:
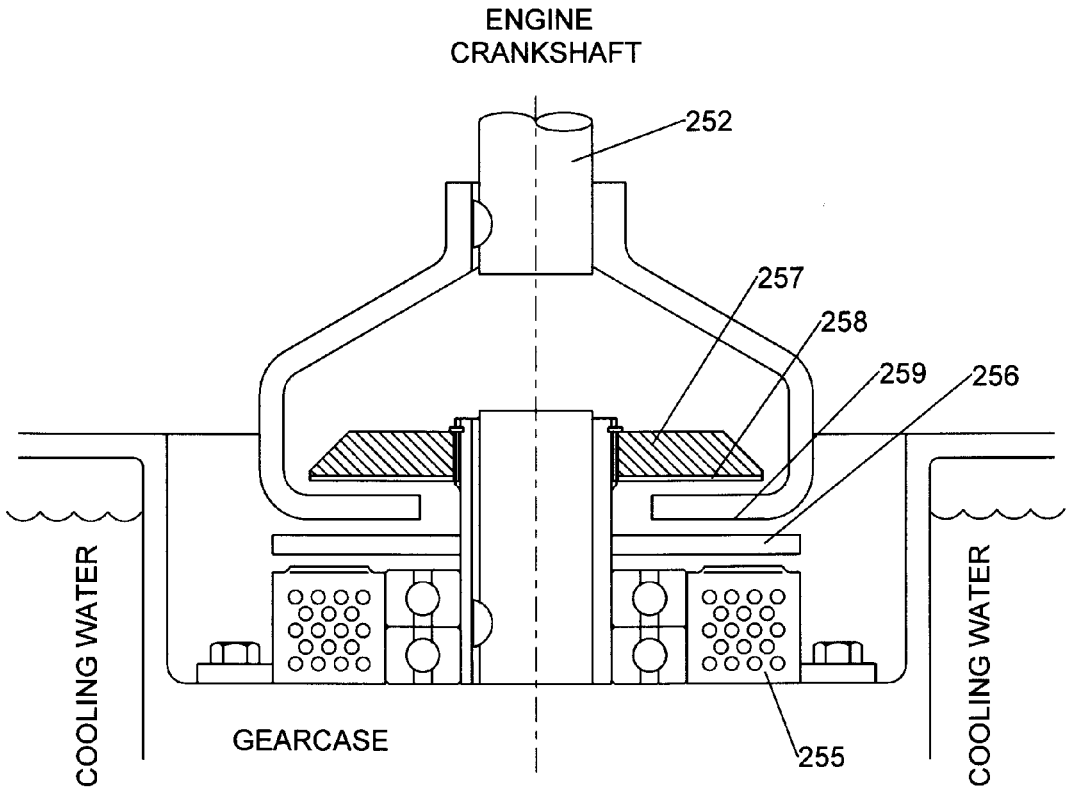

In still another embodiment, a wet disk is located inside the gear case on the vertical drive shaft. Provided it can be cooled, the wet disk clutch can tolerate light slip loads indefinitely. At low speeds, the tunnel is almost fully wetted. This means that the clutch plates are surrounded by cooling water. water. As the clutch slips the heat is taken away by the water. This electro mechanical multi-disk wet or dry clutch is illustrated in FIG. 10C. In this embodiment clutch 50 includes an electro magnetic coil 255 which is rotatably mounted on clutch input shaft 252. The electro magnetic coil is selectively energized at a predetermined RPM of the clutch input shaft 252. When voltage/current is applied to the electro magnetic coil 255 the coil produces magnetic lines of flux. This flux is then transferred through a small air gap between the field and a rotor 256. The rotor portion 256 of the clutch becomes magnetized and sets up a magnetic loop, which attracts both the armature 257 and the friction disks 258. The attraction of the armature compresses or squeezes the friction disks 258, transferring the torque from the inner driver 252 to the outer disks 259.

Figure 10D:
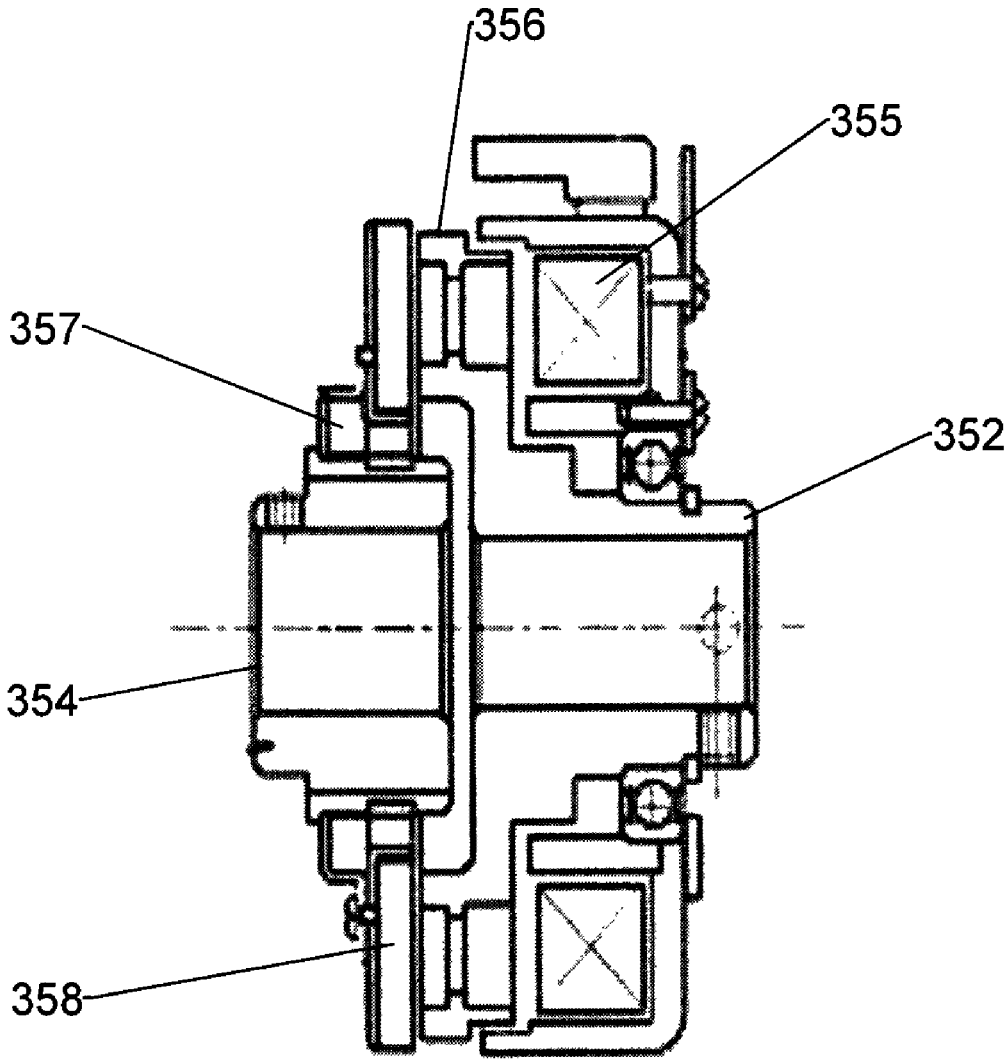

FIG. 10D shows an alternate configuration of the electromagnetic clutch shown in FIG. 10C. In this arrangement the clutch 50 includes an electro magnetic coil 355 which is rotatably mounted on clutch input shaft 352. The electro magnetic coil is selectively energized at a predetermined RPM of the clutch input shaft 352. When voltage/current is applied to the electro magnetic coil 355 the coil produces magnetic lines of flux. This flux is then transferred through a small air gap between the field and a rotor 356. The rotor portion 356 of the clutch becomes magnetized and sets up a magnetic loop, which attracts both the armature 357 and the friction disks 358. The attraction of the armature 357 compresses or squeezes the friction disks 358, transferring the torque from the inner driver 352 to the rotor 356 and then to an annular plate which has a central aperture operatively connected to the clutch output shaft 354.

Figure 11:
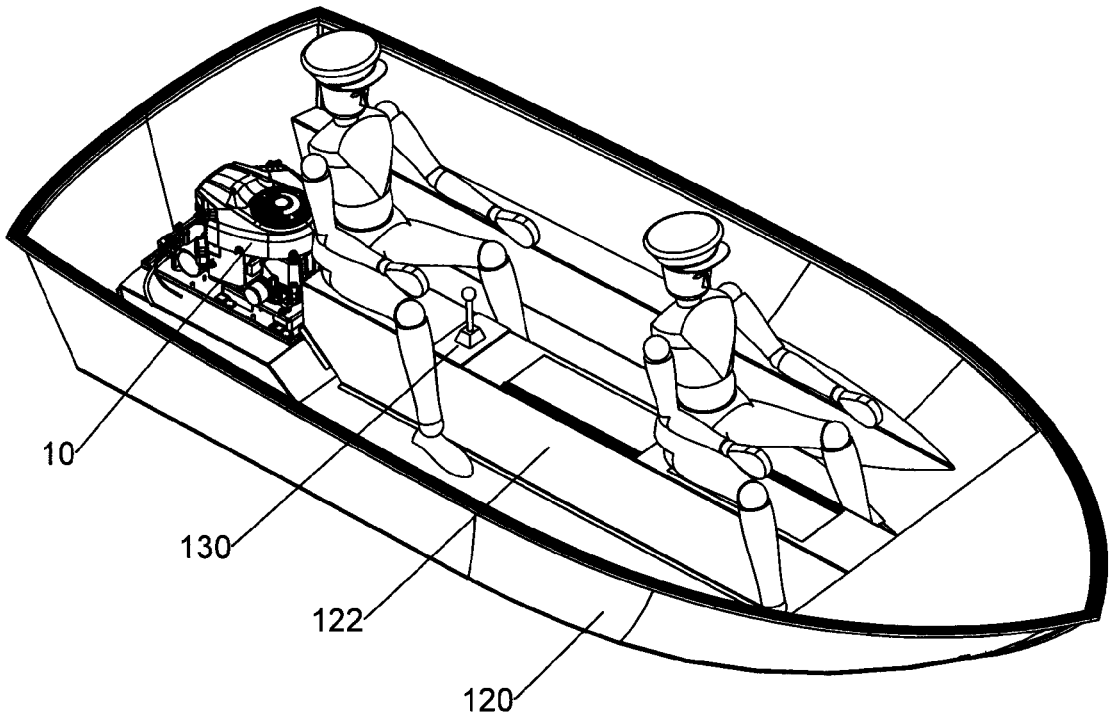
FIG. 11 is a pictorial view of the drop in module within a vessel that has a tunnel extending the length of the vessel.
Figure 12:
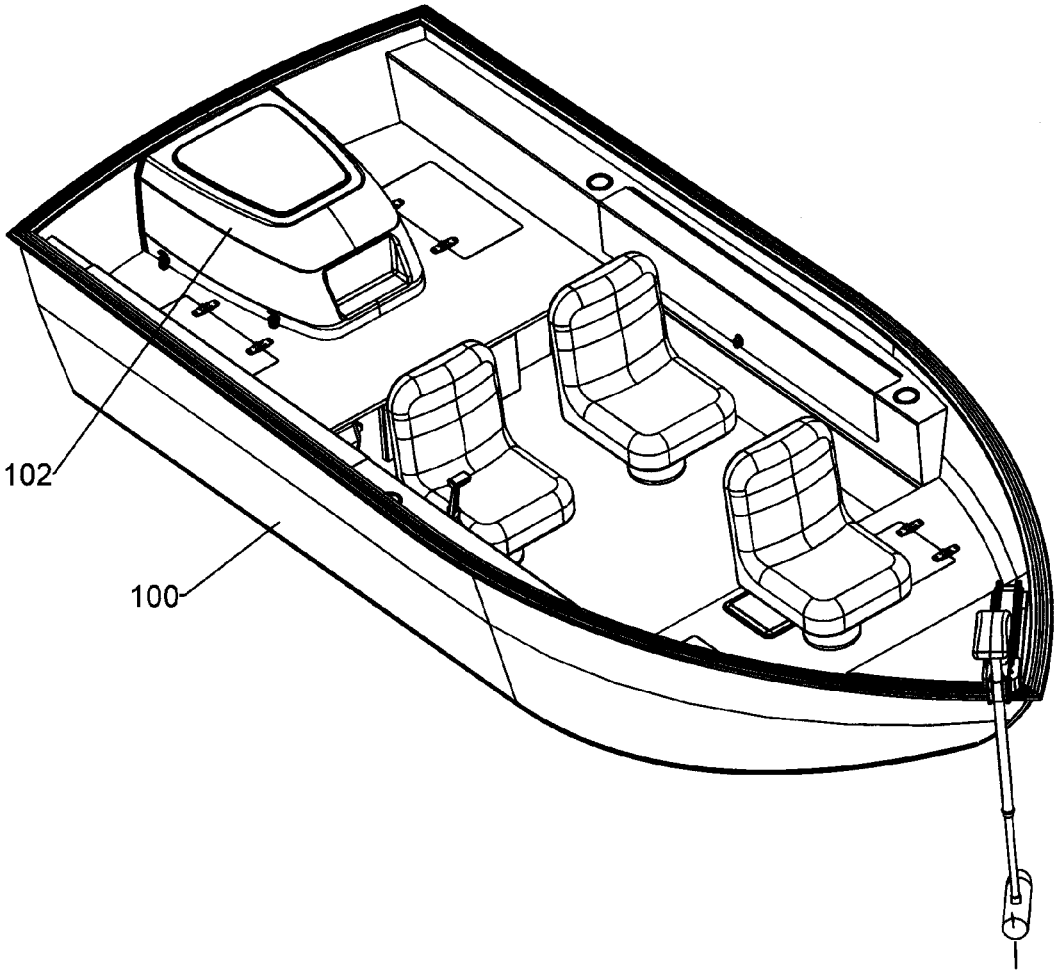
FIG. 12 is a pictorial view of a larger vessel with the drop in module placed beneath an enclosure.

FIG. 11 depicts a vessel (120) having a tunnel (122) extending the length of the vessel with controls (130) centrally located before the drop in module. FIG. 12 depicts a larger vessel (100) with a drop in module placed beneath an enclosure (102).

The drop in module is most beneficial when placed in a tunnel such as those created for surface piercing propeller. The rigid assembly is protected from impact by the tunnel shape effectively providing a zero draft vessel.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A bolt-on propulsion and steering system for a watercraft comprising: an engine having a crankshaft configured to be operational in a vertical orientation;

a mounting plate for bolting to a hull of said watercraft, said mounting plate defined by a first and second surface, said engine fastened to said first surface in a fixed position relative to the hull and orientating said crankshaft in a vertically disposed position;

a gear case fastened to said second surface in a fixed position relative to the hull, said gear case coupled to the engine providing torque transfer from said vertically disposed crankshaft to a horizontal plane;

a propeller coupled to said gear case in said horizontal plane providing propulsion propeller fluid flow when the propeller is rotated by said engine;

at least one rudder assembly fastened to said second surface at a position aft said gear case and propeller, said rudder coupled to a steering means for use in steering said watercraft by directing propeller fluid flow past said rudder;

whereby said bolt on propulsion and steering assembly can be readily installed and removed from the hull of the watercraft as a single unit.

2. The bolt-on propulsion and steering system of claim 1, wherein said bolt on propulsion and steering assembly is removably fastened to the hull of the watercraft in a fixed position with said propeller positioned in a fixed plane relative to said hull.

3. The bolt-on propulsion and steering system of claim 1, wherein said hull of the watercraft includes a tunnel, said gear box, propeller and rudder positionable substantially within said tunnel.

4. The bolt-on propulsion and steering system of claim 3, wherein said tunnel is a vented tunnel, wherein air is induced into the tunnel at a position in front of said gear box, wherein said vented tunnel provides an area of reduced pressure along said second surface of said mounting plate.

5. The bolt-on propulsion and steering system of claim 1, wherein said engine is air cooled by a venting means.

6. The bolt-on propulsion and steering system of claim 5 wherein said venting means for dispersing heat generated by said engine into a vented tunnel includes an opening along said tunnel for inducing air into said tunnel toward a bow of said watercraft relative to said propeller.

7. The bolt-on propulsion and steering system of claim 1, wherein air is induced through a hot air duct having a first opening adjacent said engine and a second opening communicating with a passageway, said passageway having a first open end communicating with an exterior of the watercraft and a second open end communication with said tunnel; wherein operating said watercraft at sufficient speed to allow the hull to plane whereby flow that is induced from the hot air duct is induced to flow through said passageway only to the second open end of the passageway and into said tunnel; and operating said watercraft at idle speed when the watercraft is at rest causing the second open end of the passageway to fill with water whereby said flow that is induced from the hot air duct is induced to flow only to the first open end of said passageway to the exterior of the watercraft.

8. A bolt-on propulsion and steering system for a watercraft comprising: an engine having a crankshaft configured to be operational in a vertical orientation;

a mounting plate for bolting to a hull of said watercraft having a tunnel, said mounting plate defined by a first and second surface, said engine fastened to said first surface in a fixed position relative to the hull and orientating said crankshaft in a vertically disposed position;

a gear case fastened to said second surface in a fixed position relative to the hull, said gear case coupled to the engine providing torque transfer from said vertically disposed crankshaft to a horizontal plane;

a propeller coupled to said gear case in said horizontal plane providing propulsion propeller fluid flow when the propeller is rotated by said engine;

at least one rudder assembly fastened to said second surface at a position aft said gear case and propeller, said rudder coupled to a device for use in steering said watercraft by directing propeller fluid flow past said rudder;

venting means for placing air into said tunnel toward a bow of said watercraft relative to said propeller;

whereby said bolt-on propulsion and steering assembly can be removably installed from the hull of the watercraft as a single unit.

9. The bolt-on propulsion and steering system of claim 8, wherein air is induced into the tunnel at a position in front of said gear box, a vented tunnel provides an area of reduced pressure along said second surface of said mounting plate.

* * * * *